US012117278B1

(12) United States Patent
Harris

(10) Patent No.: US 12,117,278 B1
(45) Date of Patent: Oct. 15, 2024

(54) PRESS WITH MICROMETER ADJUSTABLE RAM

(71) Applicant: Chris Harris, Fargo, ND (US)

(72) Inventor: Chris Harris, Fargo, ND (US)

( * ) Notice: Subject to any disclaimer, the term of this patent is extended or adjusted under 35 U.S.C. 154(b) by 103 days.

(21) Appl. No.: 18/152,540

(22) Filed: Jan. 10, 2023

Related U.S. Application Data

(60) Provisional application No. 63/300,177, filed on Jan. 17, 2022.

(51) Int. Cl.

| | |
|---|---|
| ***F42B 33/10*** | (2006.01) |
| ***F42B 35/02*** | (2006.01) |
| *B21D 51/54* | (2006.01) |
| *F42B 33/00* | (2006.01) |
| *F42B 33/02* | (2006.01) |

(52) U.S. Cl.
CPC ..... *F42B 33/10* (2013.01); *F42B 35/02* (2013.01); *B21D 51/54* (2013.01); *F42B 33/001* (2013.01); *F42B 33/02* (2013.01)

(58) Field of Classification Search
CPC ..... F42B 33/00; F42B 33/001; F42B 33/004; F42B 33/02; F42B 33/04; F42B 33/10; F42B 35/02
USPC ..... 86/19.5, 19.6, 19.7, 24
See application file for complete search history.

(56) References Cited

U.S. PATENT DOCUMENTS

| | | | | |
|---|---|---|---|---|
| 3,044,322 A | | 7/1962 | George | |
| 3,106,113 A | | 10/1963 | Trimble | |
| 3,157,407 A | | 11/1964 | Aulabaugh | |
| 4,332,185 A | | 6/1982 | Hargrove | |
| 4,836,078 A | * | 6/1989 | Lee | F42B 33/04 86/39 |
| 4,918,825 A | | 4/1990 | Lesh et al. | |
| 5,202,529 A | | 4/1993 | Shields | |
| 5,341,717 A | * | 8/1994 | Feldman | F42B 33/04 86/32 |
| 5,649,465 A | | 7/1997 | Beebe | |
| 6,397,720 B1 | | 6/2002 | Fox et al. | |
| 7,395,746 B2 | | 7/2008 | Bond et al. | |

(Continued)

OTHER PUBLICATIONS

Competition Shellholder Sets [online]. Redding, Jan. 9, 2023. Retrieved from the Internet: <URL: https://www.redding-reloading.com/index.php?option=com_content&view=article&Itemid=15&id=35%3Acompetition-shellholder-sets>.

(Continued)

*Primary Examiner* — James S Bergin
(74) *Attorney, Agent, or Firm* — CreatiVenture Law, LLC; Dennis J M Donahue, III

(57) ABSTRACT

The micrometer adjustable ram is used within a frame having die mount and lever. A die is releasably secured within the die mount and a firearm cartridge is releasably secured to the end of the ram for resizing or bullet reseating. In operation, the ram extends into an extended position and the cartridge held at the end of the ram is inserted into the die held within the die mount. To adjust the length of the cartridge that is inserted into the die and thereby the amount of resizing and seating done to the cartridge, a micrometer assembly is provided within the ram that can be adjusted by the reloader. Furthermore, the micrometer assembly can be locked prior to use to assure that the ram, and cartridge held thereon, are coaxially aligned with the center axis of the die for more precise and repeatable resizing and reloading.

20 Claims, 4 Drawing Sheets

(56) References Cited

U.S. PATENT DOCUMENTS

| | | | | |
|---|---|---|---|---|
| 8,621,773 | B2 | 1/2014 | Morrow et al. | |
| 9,846,018 | B1 | 12/2017 | Schloer | |
| 11,067,375 | B1 * | 7/2021 | Helgason ..... | B21D 51/16 |

OTHER PUBLICATIONS

Type S Bushing Dies [online]. Redding, Jan. 9, 2023. Retrieved from the Internet: <URL: https://www.redding-reloading.com/online-catalog/118-type-s-bushing-dies>.

Micro Die Adjuster [online]. Bullet Central J, Jan. 9, 2023. Retrieved from the Internet: <URL: https://www.bulletcentral.com/product/pma-micro-die-adjuster-with-thumb-screw-upgrade/>.

Quick Change Bushing [online]. Hornady, Jan. 9, 2023. Retrieved from the Internet: <URL: https://www.hornady.com/reloading/presses/lock-n-load-classic#!/>.

* cited by examiner

PRESS WITH MICROMETER ADJUSTABLE RAM

CROSS-REFERENCE TO RELATED APPLICATIONS

This application claims priority from U.S. Provisional Patent Application No. 63/300,177 filed Jan. 17, 2022 which is hereby incorporated by reference.

STATEMENT REGARDING FEDERALLY SPONSORED RESEARCH

Not Applicable.

APPENDIX

Not Applicable.

BACKGROUND OF THE INVENTION

Field of the Invention

The present invention relates to a press, and more particularly to an improved ram for a press for resizing and reloading a firearm cartridge.

Related Art

In shooting, reloading devices are well known and used by millions to produce ammunition by hand rather than rely on mass produced factory loaded ammunition. Although the motivation for choosing hand loaded ammunition may vary from shooter to shooter, it is generally understood that mass produced ammunition has limited combinations of bullet, powder, powder charge and other cartridge characteristics making customization one of the most common motivations for a shooter to choose handloaded ammunition over factory produced ammunition. In particular, experienced hand loaders understand that regular, fine adjustment of their reloading process and cartridge specifications is essential to accurate shooting, making hand loaded ammunition tailored to their application essential. As explained in the HORNADY® Reloading Manual, "What reloaders begin to understand on taking up this pastime is that they can select the components of their reloads to achieve not just a "standard, one-size-fits-all" cartridge, but ammunition custom tailored to their rifle or handgun, their shooting conditions, and the special kinds of shooting they may want to do. Reloads are tailored to your firearm. The difference between them and factory loads manufactured to work well in many different firearms, barrels, and actions is accuracy. Factory ammo is very, very good these days, but as a reloader you can, with care, usually achieve an accuracy edge." Thus, the benefits and market for hand loaded ammunition and tools for assisting with the same is well recognized by those having skill in the art.

When a brass cartridge is fired in a pistol or a rifle, the powder inside the cartridge casing expands and drives the bullet attached to the end of the cartridge casing through the barrel. This expansion forms the brass of the casing to match the walls of the chamber very precisely. After the bullet leaves the barrel, the brass relaxes and shrinks slightly to "let go" of the chamber so that the cartridge can be extracted. This shrinking is enough to allow the brass to be extracted from the chamber, but if the cartridge is loaded a second time, the brass is slightly too large for normal function. This causes two separate problems that need to be corrected before it can be reloaded. Usually, the body of the cartridge casing is resized to make it slightly smaller so that it will slide into the chamber more reliably. The other problem is that the case mouth is slightly too large to grab on to a bullet, so the neck of the cartridge casing must be resized to make it smaller so that the case mouth can hold the bullet. To address these issues, dies have long been used in combination with presses to reshape the cartridge casing by adjusting the size of the neck of to hold the bullet with the proper tension and to resize the body of the casing so that it fits properly in the chamber of the firearm.

To resize cartridges, it has long been known to use a die and press with dies being removably attached to a mount within the frame, as shown in FIGS. 1A. As the ram of the press is extended, the cartridge held on the end of the ram is inserted into the die and the mechanical leverage provided by the ram at the end of the ram stroke resizes the brass of the cartridge casing within the die. More particularly, as the cartridge is inserted into the die the brass case is compressed both radially and axially and is thereby re-sized by a desired amount. Some reloaders prefer to resize both the body of the case, known as "resizing", and the neck, known as "neck sizing", in a single die requiring only one operation to size the fired case while other reloaders prefer to size the case body and case neck in two separate operations with corresponding dies. Thus, there has been a need in the art to provide a press that can be used with multiple dies based on the reloaders preferred reloading method in addition to allowing a single reloading press to be used with different caliber firearm cartridges by simply replacing the die rather than swapping out the entire press.

Similarly, it is also long been known to use a die and press to reseat bullets within a resized cartridge, as shown in FIG. 1B. Like the resizing process, fine tune adjustments are required to assure that a bullet is reseated to a precise depth for highest possible accuracy. Bullet seating is complex because you want the case to have the right gripping tension on the bullet, both too firm and too loose are problematic. The bullet must be seated to the correct depth, the ideal seating depth for accuracy is unique to each firearm, and bullets seated too short can cause dangerous pressures. Finally, the bullet must be seated coaxially aligned with the bore line. Seating the bullet at an angle into the case mouth will cause poor accuracy. Thus, another problem exists in the art because reloaders are required to change out the resizing die for the seating die or are forced to acquire seating presses that are entirely separate from their resizing press.

To use a single press with different dies, prior art presses have been developed to include a female bushing that threadingly receives a die. Although the internal structures of the dies vary based on caliber and resizing function, their external threads are uniform so that they can be used within the same press device. Generally, the industry has standardized the thread diameter and pitch of prior art presses and dies at a diameter of seven-eighths of an inch (⅞") and a pitch of fourteen (14) threads per inch (TPI). Various dies can therefore be securely attached to the press but a problem remains because fine tune adjustments of a die within the press are not easily made.

Although a shooter may select the proper die for use with a standard press, the resizing process is a balancing act to have the smallest possible headspace between the shoulder of a bottleneck cartridge and the chamber of the firearm in which it is inserted. For example, if a firearm cartridge is not resized enough during the resizing process, the brass in the cartridge case can grow and it can be difficult to fully close the bolt on the round because the case is too long as measured between the case shoulder and the case head which contacts the bolt face. When the case is too long, the cartridge case may not relax enough after firing to allow the bolt lugs to unlock easily which can cause poor accuracy and can potentially lead to a dangerous amount of pressure in the fired round. In extreme cases, this condition can lead to enlarged primer pockets which ruins the case altogether. On the other hand, resizing a case too much can create too much headspace which results in the brass expanding beyond its elasticity. Overtime, excess expansion can cause thinning in the brass near the case head which can result in a dangerous condition that can eventually lead to a case head separation under pressure. Accordingly, there is a need in the art to provide dies that are not only usable with a standard press but also which are precisely and repeatably adjustable such that the length of the cartridge inserted into the die, and subsequently the amount of resizing that is done to the cartridge, during operation of the press can be precisely and repeatably controlled.

The conventional approach to adjusting the amount of resizing done to a case is to adjust the depth to which the resizing die is screwed into the press. Unfortunately, this results in a very coarse and non-repeatable adjustment considering the industry standard thread size for reloading dies. In particular, each full three hundred-and sixty-degree) (360° rotation of a die within the bushing of a press having the industry standard diameter of seven-eighths of an inch (⅞") and pitch of fourteen (14) TPI results in a longitudinal translation of the die within the die mounting bushing by approximately seven hundredths of one inch (0.071"). Given that precision reloaders typical headspace is adjusted by just a few thousandths of an inch, it is extremely difficult to make precision changes with such a coarse thread wherein five degrees) (5° of rotation is approximately one-thousandth of an inch (0.001").

Although novice reloaders may use a die and press to resize the casing and neck to a factory specification, there is a desire amongst experienced reloaders to precisely and repeatably resize a firearm cartridge to increase the accuracy of the next shot delivered down range. Competitive and high precision reloaders understand that correctly adjusting case sizing is a constantly changing goal. Ambient temperature, chamber temperature, the number of firing cycles for a given case, even the shooter's preference on a given day can require small changes to case sizing for optimum performance. Making small changes easy to accomplish is a large leap forward in reloading technology and there is a continual desire to provide improved reloading devices that allow more precise and repeatable adjustments.

Persons in the art have attempted to provide more precise and repeatable adjustment means by integrating micrometer mechanisms into the resizing dies that are attached to the presses. For example, U.S. Pat. No. 6,397,720 by Fox describes an improved die which uses a micrometer to allow for fine tune adjustments of the die within the bushing of the press. Although the reloader can precisely change the depth to which the cartridge is inserted into the die by adjusting the amount by which the die is screwed into the press, a problem exists with these improved dies because the reloader can only make precise adjustments when using particular dies that have a micrometer adjustment device. Not only are these more complex dies significantly more expensive than standard dies, a reloader would necessarily need to replace all of their original dies if they wanted to upgrade their hand loading station to have precise adjustments means with each and every resizing function and caliber. Thus, there remains a desire to provide improved reloading equipment that allows for precise and repeatable resizing adjustments without requiring new dies that require more cost, equipment, space and complexity.

A prior art device which offers more precise adjustment without requiring new dies altogether is the COMPETITION SHELL HOLDER™ from REDDING® which consists of several shell holders of slightly different dimensions that are sold as a kit. As shown in FIG. 2, the kit includes various shell holders that are two-thousandths of an inch (0.002"), four-thousandths of an inch (0.004"), six-thousandths of an inch (0.006") and eight-thousandths of an inch (0.008") taller, respectively. In operation, if a shooter is reloading cases and decides that they want two-thousandths of an inch (0.002") more headspace, they can move up one shell holder and the cartridge held at the end of the ram will be inserted two-thousandths of an inch (0.002") further into the die. Although this provides more precise resizing adjustment for a particular cartridge without changing the die, the dimensional change is not only fixed by the difference between the size of the chosen holder but the holders themselves are particularly tailored to a specific caliber. Accordingly, reloaders must have multiple sets of shell holders for corresponding cartridges and the adjustment range is limited to the maximum size of the shell holders, eight-thousandths of an inch (0.008"). Additionally, even with multiple sets for corresponding cartridges, adjustment amounts are incrementally fixed.

Accordingly, there remains a need for an improved press that allows for the fine tuning of the resizing and neck sizing process without necessarily altering the general operation of the cartridge holder of the ram and the attachment of the die to the press.

SUMMARY OF THE INVENTION

The firearm cartridge press with micrometer adjustable ram incorporates a new and innovative approach to making sizing changes by adjusting the length of the ram to alter the distance between the end of the ram at the top of its stroke relative to the location of the die within the press. Accordingly, the reloader can precisely and repeatably control the amount of case resizing and neck sizing done a cartridge without necessitating that the reloader procure an improved die or try to adjust the die within the press based on standard thread dimensions that do not readily allow fine tune adjustments.

An aspect of the invention described herein is the adjustable ram and integrated micrometer assembly for precisely and repeatably adjusting the length of the ram. When the length of the ram is controlled via the micrometer assembly, the amount of resizing completed on the cartridge held at the end of the ram is also precisely and repeatably controlled wherein the length of the cartridge inserted into the die varies relative to the length of ram. Although the preferred embodiment described herein includes a corresponding frame which supports the ram and lever for actuating the same, it will be appreciated that the innovative ram and micrometer assembly described herein could be retrofit with existing frames in the prior art.

The micrometer assembly itself also includes an innovative locking mechanism that not only fixes the length of the ram after adjustment by the user but also coaxially aligns the subparts of the press and ram described herein such that a cartridge held on the end of the ram is perfectly aligned with die mount into which it is inserted as the lever is actuated.

Another embodiment the invention described herein is a dual ram configuration that eliminates the need for separate resizing and bullet seating presses while still allowing for precise and repeatable adjustment during each action with corresponding micrometer assemblies within each ram. In particular, this embodiment includes a pair of rams and corresponding die mounts. Typically, one die mount would be used for a resizing die and one would be used for a bullet seating die and the micrometer assembly in each ram allows the reloader to adjust, with great precision, both the resizing operation and the seating operation on a single press. Alternatively, as some reloaders prefer to resize the body of the casing from the neck, the dual ram and die mount configuration allows the reloader to use multiple resizing dies within a single press so that they can more quickly complete the resizing process without necessarily switching dies within the press.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

The micrometer adjustable ram used within a press for resizing and reloading a firearm cartridge as described herein works in unison with a frame having a die mount and a lever. A die is releasably secured within the die mount and a firearm cartridge is releasably secured to the end of the ram for resizing or for bullet reseating. In operation, when the lever is used to actuate the ram, the ram extends into an extended position and the cartridge held at the end of the ram is inserted into the die held within the die mount. To adjust the length of the cartridge that is inserted into the die and thereby the amount of resizing and seating parameters done to the cartridge, a micrometer assembly is provided within the ram that can be adjusted by the reloader. When the micrometer assembly is used to lengthen the ram, the cartridge is inserted further into the die. Conversely, when the micrometer assembly is used to shorten the ram, less of the cartridge is inserted into the ram.

Figure 1B:
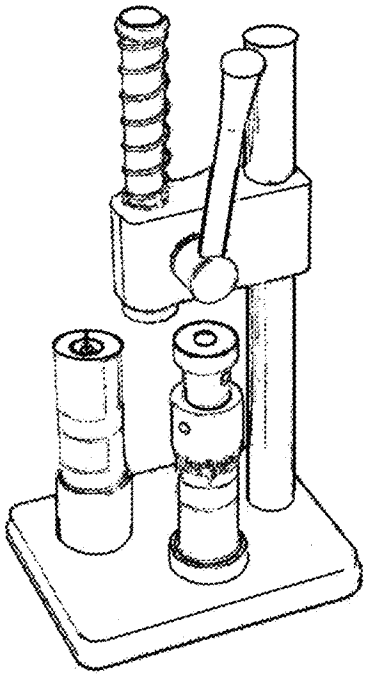
Fig. 1B (Prior Art)
FIGS. 1A and 1B depict reloading press and die assemblies in the prior art.
Figure 2:
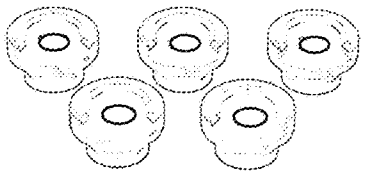
Fig. 2 (Prior Art)
FIG. 2 depicts a cartridge holder in the prior art.
Figure 1A:
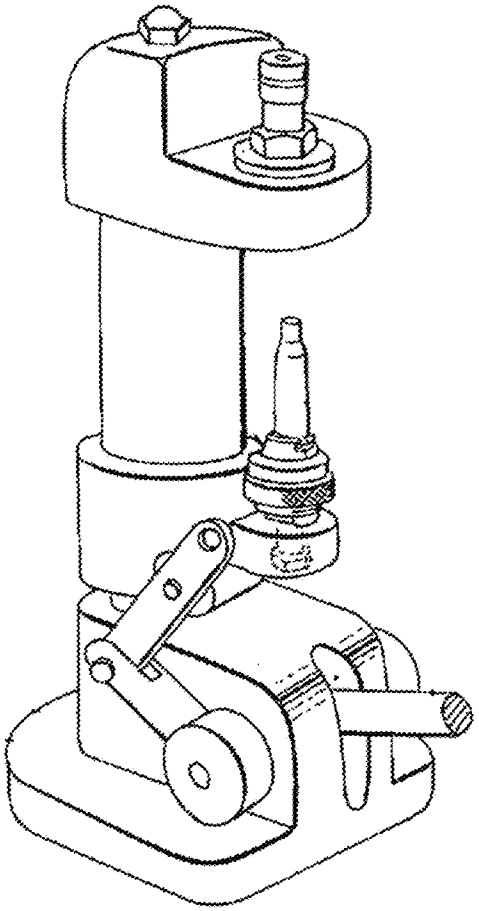
Fig. 1A (Prior Art)
Figure 3B:
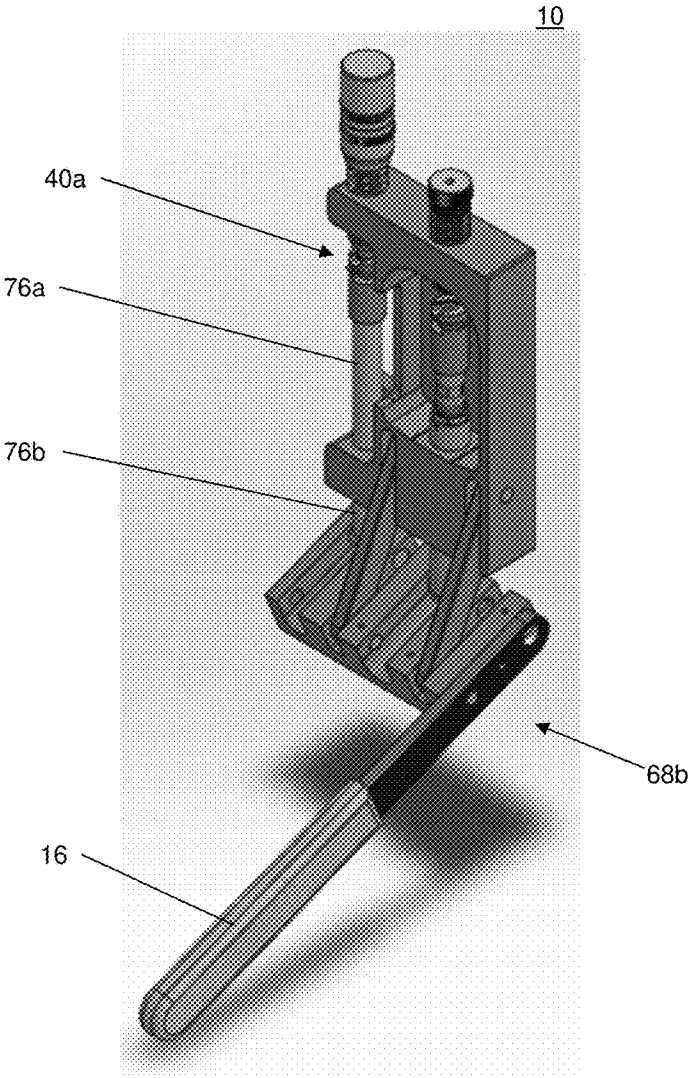
FIGS. 3A and 3B are perspective views respectively showing the ram in the retracted position and extended position according to the invention described herein.
Figure 3A:
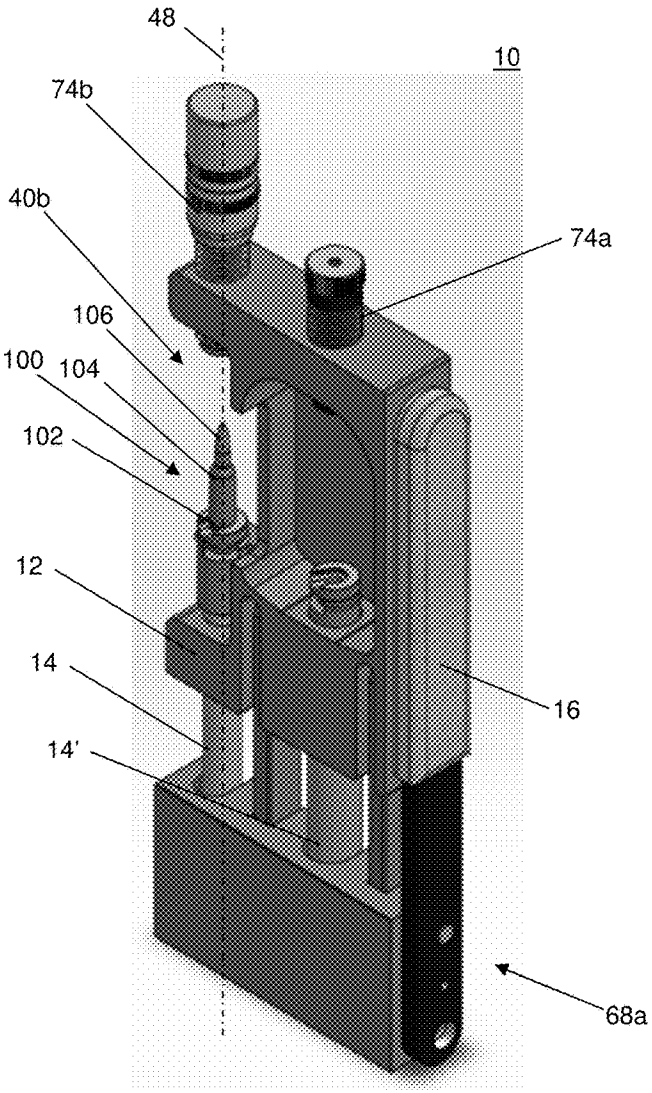
Figure 3C:
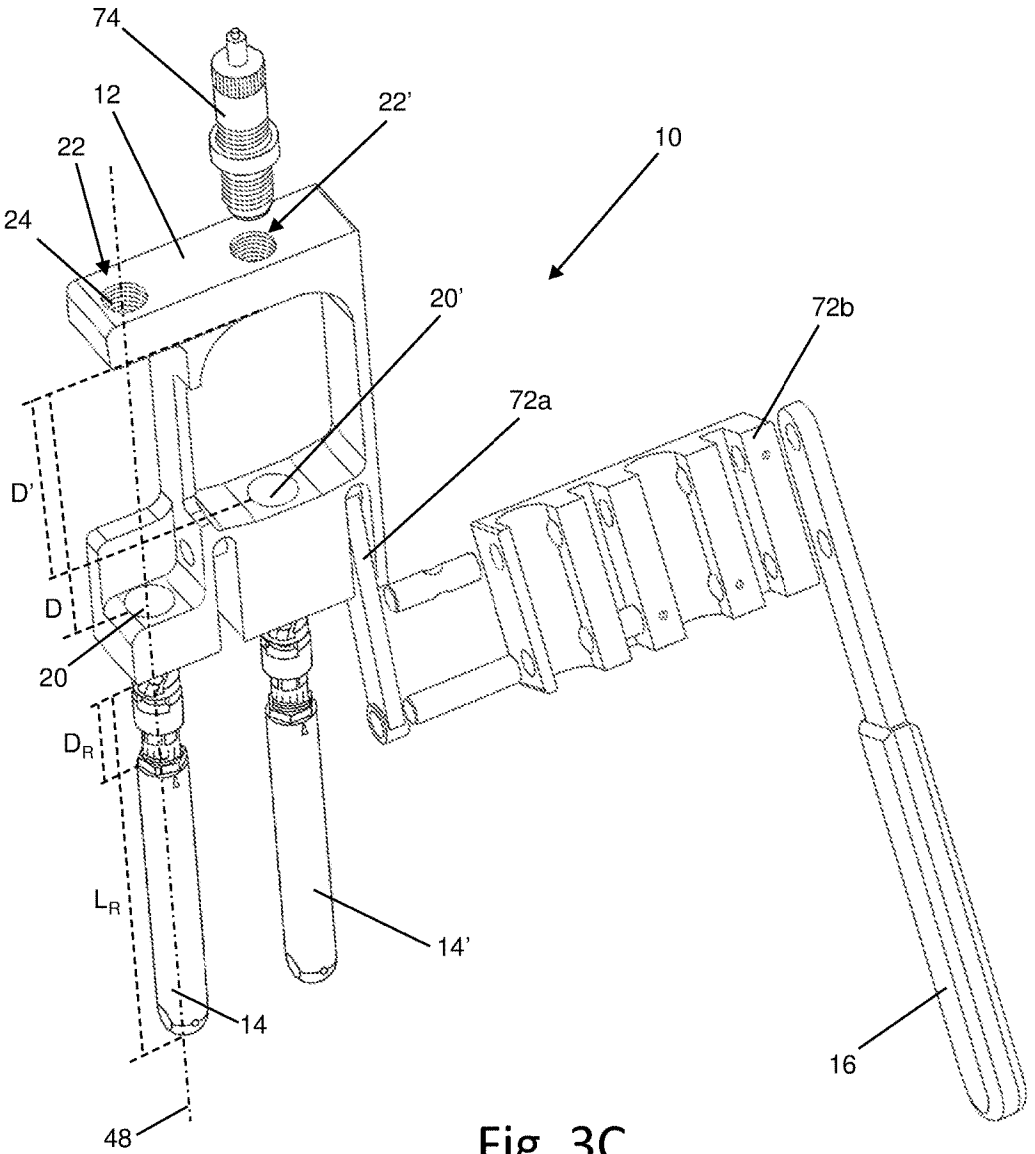
FIG. 3C is an exploded view of a press according to the invention described herein.

The frame 12 of the press 10 includes a ram aperture 20 for guiding the ram as it longitudinally translates within the ram aperture towards the die mount 22 that is spaced a distance (D) from the ram aperture. To secure the die to the frame, the die mount has a threaded bore 24 which threadingly receives the cartridge die 74. As shown in FIG. 3C, the ram aperture and die mount are coaxially aligned along a central longitudinal axis 48 along which the ram translates as the user actuates the lever. Thus, the cartridge connected to the end of the ram is aligned with the die that is secured within the die mount as described below.

Although the diameter of the threaded bore and threads therein are not intended to be limiting, the preferred press includes a threaded bore with threads having a diameter of seven-eighths of an inch (⅞") and a pitch of fourteen (14) TPI to match the industry standard discussed in the background section above. Accordingly, the preferred die that is secured within the die mount has equivalent thread dimensions to assure a secure fit within the die mount.

The ram 14 of the press is slidingly engaged within the ram aperture and reciprocates through ram aperture between an extended position 40*a* and a retracted position 40*b*. The ram includes a fixed end 26*a* that attaches to a lever 16 for actuating the ram and a free end 26*b* spaced the length of the ram (LR) from the fixed end. As shown in FIG. 3A, the primer end 102 of the cartridge 100 is attached to the free end of the ram which extends towards the die mount and retracts away from the die mount as the lever moves between the unactuated position 68*a* and actuated position 68*b*. A proximal portion 76*a* of the ram slides within the ram aperture and a distal portion 76*b* protrudes outside of the ram aperture with the free end at the distal portion being opposite from the proximal portion and situated outside the ram aperture.

Figure 4:
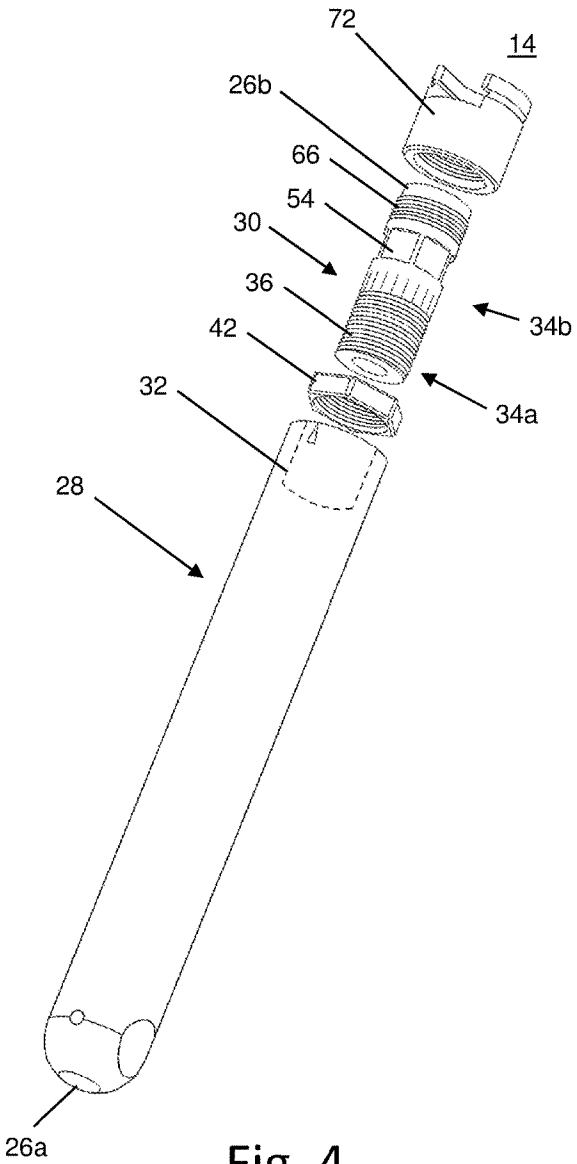
FIG. 4 is an exploded view of a ram according to the invention described herein.

Although the cartridge can be secured to the free end of the ram by any number of means, a customized press according to the invention described herein may include a separate cartridge holder 72 which corresponds with the caliber of the firearm cartridge being reloaded by the reloader. In operation, the preferred cartridge holder releaseably attaches to the free end of the ram, such as with threads 66 on the end of the cylinder portion of the micrometer assembly that forms the free end of the ram as shown in FIG. 4. Alternatively, a universal cartridge holder that is not limited to one caliber could be releasably or fixedly attached the free end of the ram.

Figure 6B:
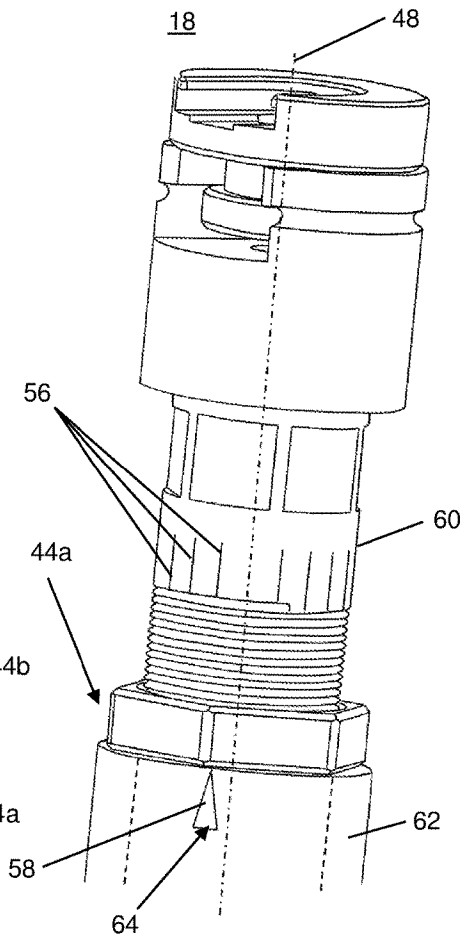
FIGS. 6A and 6B are detail views of the micrometer assembly according to the invention described herein.
Figure 6A:
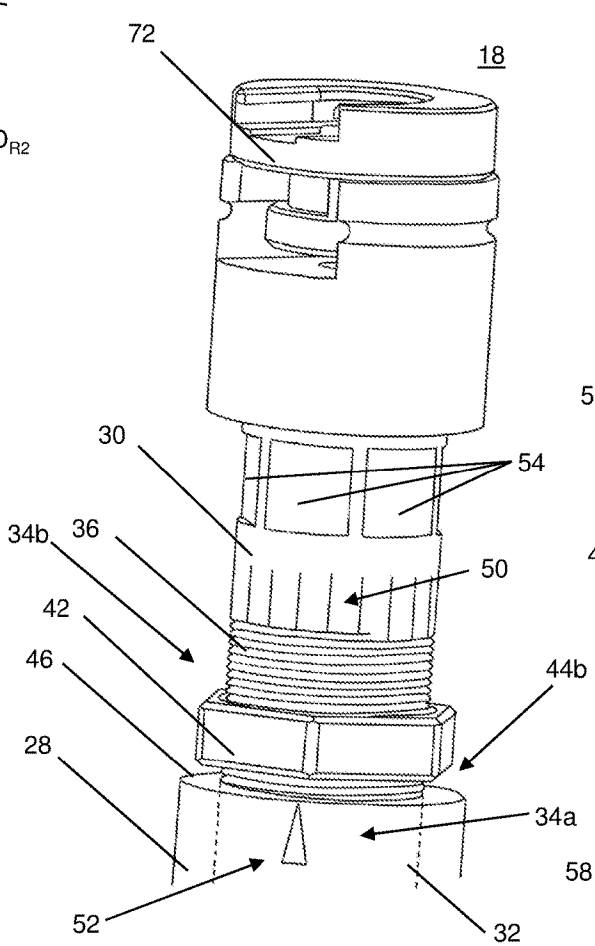
Figure 5B:
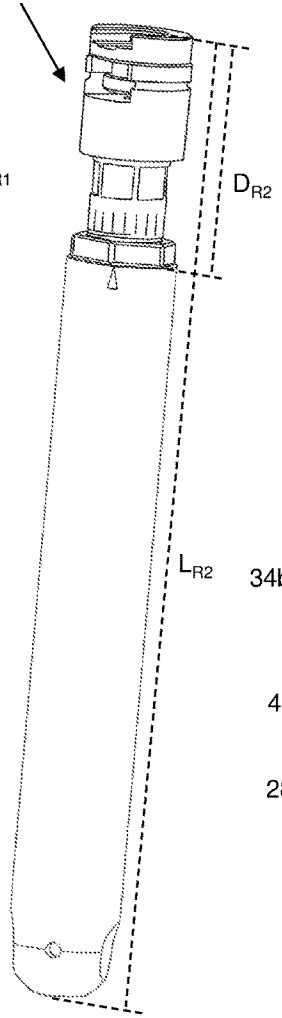
FIGS. 5A and 5B are perspective views of a ram at different lengths according to the invention described herein.
Figure 5A:
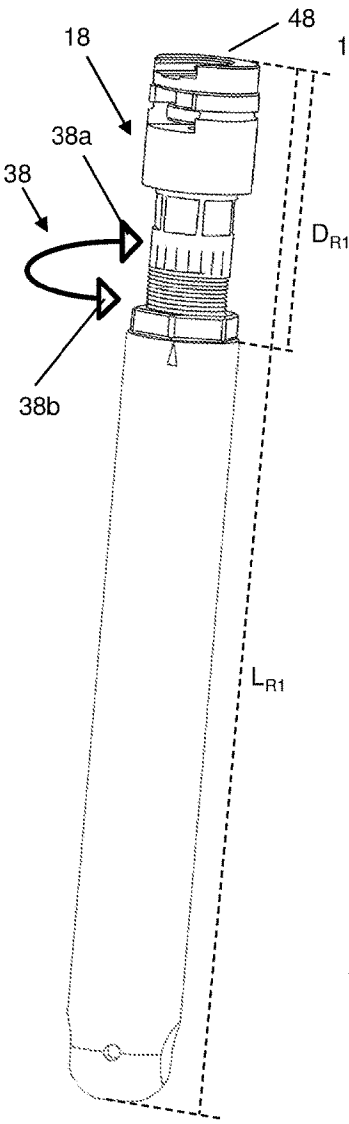

As particularly shown in FIGS. 5 and 6, the free end of the ram includes a micrometer assembly 18. The micrometer assembly is made up of a sleeve 28 surrounding a cylinder 30 with a portion 34*a* of the cylinder being threadingly received within the sleeve and another portion 34*b* outside of the sleeve. The cylinder therefore includes a threaded external surface 36 at least within the portion within the sleeve which engages with a threaded internal sidewall 32 of the sleeve. In operation, the cylinder rotates 38 within the sleeve by a degree of rotation and subsequently adjusts the ram length by a distance (DR) corresponding with the degree of rotation.

In the preferred embodiment, the distance adjustment correlates to the amount the cylinder protrudes from the sleeve and the distance is therefore measured between the cylinder and the free end of the ram. However, it will be appreciated that alternative embodiments could position the micrometer assembly at another location along the length of the ram without changing the principle of operation of the ram such that the overall length of the ram is lengthened or shortened based on distance change as the cylinder is rotated within the sleeve. The ram therefore has a first length ($L_{R1}$) and either increases or decreases to a second length ($L_{R2}$) when the cylinder is rotated within the sleeve. Although the particular direction of rotation is not intended to be limiting, it will be appreciated that rotating the cylinder within the sleeve in one direction 38*a* increases the ram length by the distance ($D_{R1}$) corresponding to the degree of rotation while rotating the cylinder within the sleeve in the other direction 38*b* shortens the ram length by the distance ($D_{R1}$) corresponding with the degree of rotation.

Similar to the thread dimensions of the threaded bore and die discussed above, the thread diameter and pitch of the sleeve and cylinder and their relation to the lengthening and shortening of the ram are not intended to be limiting. However, in the preferred embodiment the thread pitch of the threaded internal sidewall of the sleeve and the threaded external surface of the cylinder are a factor of two times finer than the thread pitch of the threaded bore. Based on the standard thread pitch of fourteen (14) TPI for the threaded bore that receives the die, the threads pitch within the micrometer assembly are therefore at least twenty-eight (28) TPI but have a nominal TPI of forty (40). With regard to the relative distance change in the length of the ram based on the variation in thread pitch, the correlation between the degree of rotation and distance by which the ram length is either shortened or increased is therefore no more than thirty-six thousandths of an inch (0.036") and is preferably closer to twenty-thousandths of an inch (0.020") per one full three hundred-and sixty-degree) (360°. Accordingly, the micrometer assembly allows for more precise and repeatable adjustments of the ram length by less than one-thousandth of an inch (0.001") with more than five degrees) (5° of rotation.

Despite the preferred dimensional relationships referenced above, it will be appreciated by those having an ordinary skill in the art that variance of the relative dimensional length change based on rotation of cylinder in the sleeve of the micrometer described herein will not change its principle of operation. Thus, the relative dimensional relationships are preferred and not required such that any thread dimension could be included in the ram described herein.

Once the reloader has rotated the cylinder by the desired degree of rotation and lengthened the ram to the desired length, the reloader can lock the ram length in place so that it does not inadvertently change during operation of the press. A locking nut 42 is incorporated into the micrometer assembly and threads around the threaded portion of the cylinder that is outside of the sleeve between a locked position 44*a* and an unlocked position 44*b*. When locked, the locking nut abuts an edge 46 of the cylinder and prevents the cylinder from further rotating within the sleeve, thereby locking the length of the ram. Conversely, the locking nut can be unlocked by rotating it around the cylinder away from the edge of the sleeve. When unlocked, the cylinder can freely rotate within the sleeve and the length of the ram can be adjusted as desired by the reloader.

In addition to fixing the length of the ram in place, the locking nut also coaxially aligns the central longitudinal axes of each of the cylinder, sleeve, ram aperture and die mount. As the cylinder threads within the sleeve, the respective center axes may lateral shift in and out of coaxial alignment as the respective crests and roots of the opposing threads move relative to one another. However, once the micrometer is set to a specific length by the user, the locking nut securely abuts the edge of the cylinder and fixes the sleeve and cylinder into coaxial alignment without any lateral shift. With the subparts of the ram coaxially aligned with one another, the longitudinal axis of the ram itself is coaxially aligned with center axis of the ram aperture and die mount within the frame such no lateral offset within the ram will affect the cartridge as it is pressed into the die during operation.

To indicate the relative length of the ram based on rotation of the micrometer assembly as described above, cylinder indicia 50 and sleeve indicia 52 are provided to collectively indicate the relative distance change based on the degree of rotation. The cylinder indicia are provided around the circumference 60 of the unthreaded portion of the cylinder. Similarly, the sleeve includes indicium that is preferably an arrowhead 58 at location 64 on the exterior 62 of the sleeve which points to the cylinder indicia corresponding to the length of the ram. Although the preferred cylinder indicia include equidistant vertical hash marks 56 that are parallel to the longitudinal axis cylinder and which correspond to a change in longitudinal dimensions of the ram, such as each hash being one-thousandths of an inch (0.001"), other types of indicia may be used without departing from the inventive aspects of the improved press described herein. For example, rather than indicate the relative distance change, other indicia could be used to indicate the overall ram length.

The cylinder of the micrometer assembly also includes a bearing surface 54 which the user can grasp to more precisely and repeatably control adjustment of the ram. The bearing surface is located on the unthreaded portion of the cylinder between the free end of the ram and the top thread of the threaded portion. Preferably, the bearing surface is a series of recesses but it will be appreciated that other types of surfaces could be used to improve the grasp of a user adjusting the length of the ram. Thus, the recesses shown in the drawings are not intended to be limiting.

Although the particular construction of the die received within the die mount of the frame is not intended to be limiting, it will be appreciated that the die consists of either a resizing die 74*a* for shaping one or both of the cartridge casing and neck or a seating die 74*b* for seating the bullet within the neck of the cartridge. A single ram embodiment may effectively improve upon existing presses that do not allow for precise and repeatable control of cartridge resizing with a micrometer assembly within the ram as described herein, the preferred embodiment of the improved press includes a single frame having a pair of rams 14 and 14', ram apertures 20 and 20' and die mounts 22 and 22' as shown in FIGS. 3A, 3B and 3C. The frame of the dual ram embodiment may include uniform or offset dimensions, such as the varied distance (D and D') between the ram aperture and die mount as shown in FIG. 3C. Furthermore, the lever for actuating the ram may include connecters 70*a* and 70*b* for operatively connecting the lever to multiple rams. However, these dimensional and engineering differences do not change the principle of operation of the inventive ram and press described herein.

In the dual-ram embodiment a pair of cartridge dies are received within respective die mounts and the reloader can quickly seat a bullet within the second die after the cartridge has been resized by the first die, all without swapping out dies from the frame. Thus, the die cartridge is selected from either a resizing die or a seating die with the preferred dual-ram embodiment having one of each die type as shown in FIG. 3A.

As explained in detail with regard to known dies in the prior art, it will be appreciated that the resizing die is configured to reshape at least a portion of the firearm cartridge when the firearm cartridge is inserted into the cartridge die and the bullet seating die is configured to seat a bullet 106 within the neck end 104 of the firearm cartridge opposite from the primer end when the firearm cartridge is inserted into the cartridge die. Alternatively, a reloader can more particularly customize the dies they wish to use in the frame and may attached multiple resizing dies or multiple seating dies within the frame at once.

In addition to allowing for more precise and repeatable control of the amount of resizing completed on a casing, the improved ram described herein also allows the die to be set at the same location prior to each use. To set the die, the reloader can set the micrometer to a position with a significant amount of room to shorten the ram. Then, the ram can be fully extended and the die can be inserted into the die mount until the bottom end of the die makes contact with the free end of the ram. The die can subsequently be locked into the die mount with the standard locking mechanism incorporated into standard dies and the ram can be shorted to the setting that results in the ideal headspace for the cartridge being resized with the set die. The difference between the original lengthened setting when the die was first set and the correct head space setting can be recorded and the difference can subsequently be used for later mountings of the same die. Accordingly, the adjustable ram assures a precise and repeatable die setting process even with coarse threads between the die and press.

In alternative embodiments of the improved press described herein, the micrometer assembly can be spaced away from the ram without departing from the invention as described herein. For example, other versions could integrate the micrometer device at the fixed end of the ram rather than towards the free end. This would have the disadvantage of requiring the press to be fully disengaged when adjusting the micrometer device but, it would have the advantage of protecting the fine micrometer threads within the precision bored ram aperture in the press body while the press was disengaged which would be useful during transportation. Furthermore, the traditional reloading press mechanism is arranged such that the ram connects to the handle lever with a rotating joint and the handle lever body is connected to the press body via a linkage with rotating joints on both ends. In the invention described herein, the handle lever body is a machined part that surrounds the rams in the disengaged position. However, in other press designs, the handle lever body is simply an external part that serves no other function other than to provide the linkage for the leverage mechanism. Thus, the micrometer assembly could be integrated into the lever linkage rather than the ram itself without departing from the inventiveness of the improved press. By using a micrometer adjustable handle lever body, it is possible to adjust the effective length of the ram when the press is fully engaged.

The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. For example, as reference herein, the existing ram or levers could be modified to include a micrometer assembly and subsequently used with their other original parts. These rams and levers could therefore be marketed as an aftermarket, retrofit part that, effectively allows traditional presses to operate according to the invention described herein. Thus, the breadth and scope of the present invention should not be limited by any of the above-described exemplary embodiments, but should be defined only in accordance with the following claims appended hereto and their equivalents.

What is claimed is:

1. A press for a firearm cartridge, comprising:

a frame comprising a ram aperture and a die mount, wherein the die mount comprises a threaded bore, and wherein the ram aperture is spaced a first distance from the die mount;

a ram slidingly engaged within the ram aperture, wherein the ram comprises a fixed end, a free end, and a micrometer assembly situated proximate to the free end, wherein the ram longitudinally extends a ram length from the fixed end to the free end, wherein the micrometer assembly comprises a sleeve and a cylinder, wherein the sleeve comprises a threaded internal sidewall, wherein the cylinder comprises a first portion at least partially within the sleeve and a second portion outside of the sleeve, wherein the first portion of the cylinder comprises a threaded external surface engaged with the threaded internal sidewall of the sleeve, wherein a rotation of the cylinder by a degree of rotation within the sleeve adjusts the ram length by a second distance between a first ram length and a second ram length corresponding with the degree of rotation, and wherein the free end releasably holds the firearm cartridge; and a lever operatively connected to the fixed end of the ram, wherein actuation of the lever reciprocates the ram through the ram aperture between an extended position and a retracted position, and wherein the free end is closer to the die mount in the extended position than in the retracted position.

2. The press of claim 1, wherein the rotation of the cylinder within the sleeve by the degree of rotation comprises a first direction and a second direction, wherein the first direction increases the ram length by the second distance corresponding to the degree of rotation, wherein the second direction decreases the ram length by the second distance corresponding to the degree of rotation, and wherein the first direction is opposite from the second direction.

3. The press of claim 1, wherein the micrometer assembly further comprises a locking nut threaded around the first portion of the cylinder, wherein the locking nut rotates between a locked position and an unlocked position, wherein the locking nut abuts an edge of the sleeve in the locked position, wherein the cylinder freely rotates within the sleeve when the locking nut is in the unlocked position, and wherein the cylinder is inhibited from rotating within the sleeve, the second distance is fixed and the cylinder and the sleeve are coaxially aligned along a central longitudinal axis when the locking nut is in the locked position.

4. The press of claim 1, wherein the second portion of the cylinder comprises a first indicia and a bearing surface, wherein the sleeve further comprises a second indicia, wherein the first indicia and the second indicia collectively indicate the second distance, and wherein the bearing surface is situated between the free end of the ram and the first portion of the cylinder.

5. The press of claim 4, wherein the first indicia comprises a series of equidistantly spaced lines spaced around a circumference of the second portion of the cylinder, wherein the second indicia comprises an arrowhead indicium positioned at a location on a exterior surface of the sleeve, and wherein the arrowhead indicium aligns with one of the equidistantly spaced lines to indicate the second distance.

6. The press of claim 1, wherein the fixed end of the ram comprises a proximal portion slidingly engaged within the ram aperture and a distal portion extending beyond the ram aperture, wherein the free end is situated outside the ram aperture, and wherein the free end releasably receives a cartridge holder corresponding with a caliber of the firearm cartridge.

7. The press of claim 1, wherein each of the threaded bore, the threaded internal sidewall of the sleeve and the threaded external surface of the cylinder comprise a thread diameter and a thread pitch, and wherein the thread pitch of the threaded internal sidewall of the sleeve and the threaded external surface of the first portion of the cylinder are less than the thread pitch of the threaded bore by at least a factor of two.

8. The press of claim 7, wherein the thread diameter of the threaded bore is equal to seven-eighths of one inch, and wherein the thread pitch of the threaded bore is equal to fourteen threads per inch.

9. The press of claim 1, wherein the second distance corresponding to the degree of rotation equal to three hundred and sixty degrees is no more than thirty-sixth thousandths of one inch.

10. The press of claim 1, further comprising a cartridge die threadingly received within the threaded bore of the die mount, wherein the free end further comprises a cartridge holder corresponding with a caliber of the firearm cartridge, wherein the cartridge holder is releasably secured to the free end, and wherein the firearm cartridge held on the free end is inserted into the cartridge die when the ram is in the extended position.

11. The press of claim 10, further comprising another ram and another cartridge die respectively corresponding with another ram aperture and another die mount within the frame, wherein the lever operatively connects to the fixed end of the other ram, wherein actuation of the lever reciprocates the ram and the other ram respectively through the ram aperture and the other ram aperture between the extended position and the retracted position, wherein the cartridge die comprises one of a resizing die and a bullet seating die, wherein the other cartridge die comprises the other of the resizing die and the bullet seating die, wherein the resizing die is configured to reshape at least a portion of the firearm cartridge when the firearm cartridge is inserted into the cartridge die, and wherein the bullet seating die is configured to seat a bullet within a second end of the firearm cartridge opposite from the a first end held by the cartridge holder when the firearm cartridge is inserted into the cartridge die.

12. A press for a firearm cartridge, comprising:

a frame comprising a pair of ram apertures and a pair of die mounts each having a threaded bore, wherein the pair of ram apertures are respectively spaced a first distance from a corresponding die mount from the pair of die mounts;

a pair of rams each slidingly engaged within a corresponding ram aperture from the pair of ram apertures, wherein each of the rams comprise a fixed end, a free end, and a micrometer assembly situated proximate to the free end, wherein each of the rams longitudinally extend a ram length from the fixed end to the free end, wherein each micrometer assembly comprises a sleeve and a cylinder, wherein the sleeve comprises a threaded internal sidewall, wherein the cylinder comprises a first portion at least partially within the sleeve and a second portion outside of the sleeve, wherein the first portion of the cylinder comprises a threaded external surface engaged with the threaded internal sidewall of the sleeve, wherein rotation of the cylinder by a degree of rotation within the sleeve adjusts the ram length by a second distance between a first ram length and a second ram length corresponding with the degree of rotation, and wherein the free end of one of the rams releasably holds the firearm cartridge;

a lever operatively connected to the fixed ends of the pair of rams, wherein actuation of the lever reciprocates the rams through the corresponding ram apertures between an extended position and a retracted position, and wherein the free ends are closer to the corresponding die mounts in the extended position than in the retracted position;

a resizing die threadingly received within the threaded bore of one of the pair of die mounts; and a bullet seating die threadingly received within the threaded bore of the other of the pair of die mounts, and wherein the firearm cartridge held on the free end of one of the rams is inserted into one of the resizing die and the seating die in the extended position.

13. The press of claim 12, wherein the micrometer assembly further comprises a locking nut threaded around the first portion of the cylinder, wherein the locking nut rotates between a locked position and an unlocked position, wherein the locking nut abuts an edge of the sleeve in the locked position, wherein the cylinder freely rotates within the sleeve when the locking nut is in the unlocked position, and wherein the cylinder is inhibited from rotating within the sleeve, the second distance is fixed and the sleeve and the cylinder are coaxially aligned coaxially aligned along a central longitudinal axis when the locking nut is in the locked position.

14. The press of claim 12, wherein the second portion of the cylinder comprises a first indicia and a bearing surface, wherein the sleeve further comprises a second indicia, wherein the bearing surface is situated between the free end of the arm and the first indicia, wherein the first indicia comprises a series of equidistantly spaced lines spaced around a circumference of the second portion of the cylinder, wherein the second indicia comprises an arrowhead indicium positioned at a location on an exterior surface of the sleeve, and wherein the arrowhead indicium aligns with one of the equidistantly spaced lines to indicate the second distance.

15. The press of claim 12, wherein each of the threaded bore, the threaded internal sidewall of the sleeve and the threaded external surface of the cylinder comprise a thread diameter and a thread pitch, wherein the thread pitch of the threaded internal sidewall of the sleeve and the threaded external surface of the first portion of the cylinder are less than the thread pitch of the threaded bore by at least a factor of two, and wherein the thread diameter and the thread pitch of the threaded bore are respectively equal to seven-eighths of an inch and fourteen threads per inch.

16. The press of claim 12, wherein the rotation of the cylinder within the sleeve by the degree of rotation comprises a first direction and a second direction, wherein the first direction increases the ram length by the second distance corresponding to the degree of rotation, wherein the second direction decreases the ram length by the second distance corresponding to the degree of rotation, and wherein the second distance corresponding to the degree of rotation equal to three hundred and sixty degrees is no more than thirty-sixth thousandths of one inch.

17. In a reloading press for a firearm cartridge having a frame, a ram, a lever and a die, the improvement in the ram comprising:

a fixed end and a free end longitudinally spaced by a ram length; and a micrometer assembly situated proximate to the free end of the ram, wherein the micrometer assembly comprises a sleeve and a cylinder, wherein the sleeve comprises a threaded internal sidewall, wherein the cylinder comprises a first portion at least partially within the sleeve and a second portion outside of the sleeve, wherein the first portion of the cylinder comprises a threaded external surface engaged with the threaded internal sidewall of the sleeve, wherein a rotation of the cylinder by a degree of rotation within the sleeve adjusts the ram length by a distance between a first ram length and a second ram length corresponding with the degree of rotation, and wherein the free end releasably holds the firearm cartridge.

18. The ram in the reloading press of claim 17, wherein the micrometer assembly further comprises a locking nut threaded around the first portion of the cylinder, wherein the locking nut rotates between a locked position and an unlocked position, wherein the locking nut abuts an edge of the sleeve in the locked position, wherein the cylinder freely rotates within the sleeve when the locking nut is in the unlocked position, and wherein the cylinder is inhibited from rotating within the sleeve, the second distance is fixed and the cylinder and the sleeve are coaxially aligned along a central longitudinal axis when the locking nut is in the locked position.

19. The press of claim 17, wherein the second portion of the cylinder comprises a first indicia and a bearing surface, wherein the sleeve further comprises a second indicia, wherein the bearing surface is situated between the free end of the ram and the first indicia, wherein the first indicia comprises a series of equidistantly spaced lines spaced around a circumference of the second portion of the cylinder, wherein the second indicia comprises an arrowhead indicium positioned at a location on an exterior surface of the sleeve, and wherein the arrowhead indicium aligns with one of the equidistantly spaced lines to indicate the distance.

20. The ram in the reloading press of claim 17, wherein the rotation of the cylinder within the sleeve by the degree of rotation comprises a first direction and a second direction, wherein the first direction increases the ram length by the second distance corresponding to the degree of rotation, wherein the second direction decreases the ram length by the second distance corresponding to the degree of rotation, and wherein the first direction is opposite from the second direction.

* * * * *